US006755001B2

(12) United States Patent
Eaton

(10) Patent No.: US 6,755,001 B2
(45) Date of Patent: Jun. 29, 2004

(54) SUSPENDED CONCRETE FLOORING SYSTEM AND METHOD

(75) Inventor: Peter Francis Eaton, Oatley (AU)

(73) Assignee: James Hardie Research Pty Limited (AU)

( * ) Notice: Subject to any disclaimer, the term of this patent is extended or adjusted under 35 U.S.C. 154(b) by 0 days.

(21) Appl. No.: 09/978,636

(22) Filed: Oct. 15, 2001

(65) Prior Publication Data

US 2002/0078646 A1 Jun. 27, 2002

Related U.S. Application Data

(60) Provisional application No. 60/241,042, filed on Oct. 16, 2000.

(51) Int. Cl.[7] ..... E04B 5/16

(52) U.S. Cl. ..... 52/506.06; 52/299; 52/335; 52/480

(58) Field of Search ..... 52/506.06, 299, 52/294, 480, 414, 327, 328, 338, 335, 710, 716.8, 724.2

(56) References Cited

U.S. PATENT DOCUMENTS 4,335,557 A * 6/1982 Morton ..... 52/745.05
4,597,233 A * 7/1986 Rongoe, Jr. ..... 52/334
5,519,971 A * 5/1996 Ramirez ..... 52/220.2
5,809,722 A * 9/1998 Bertsche ..... 52/334
5,857,292 A * 1/1999 Simpson ..... 52/22
5,927,041 A * 7/1999 Sedlmeier et al. ..... 52/730.1
6,044,610 A * 4/2000 DeVon et al. ..... 52/653.1
6,094,873 A * 8/2000 Hoffman et al. ..... 52/126.6
6,189,274 B1 * 2/2001 Ollikainen ..... 52/264
6,192,636 B1 * 2/2001 Hayashi et al. ..... 52/126.7

* cited by examiner

*Primary Examiner*—Carl D. Friedman
*Assistant Examiner*—Basil Katcheves
(74) *Attorney, Agent, or Firm*—Knobbe Martens Olson & Bear LLP

(57) ABSTRACT

A suspended concrete flooring system (100) comprising a plurality of spaced-apart load-bearing members (110) or supporting walls that support a plurality of joists (122) having opposing sides and arranged substantially at right-angles to the load-bearing members. The joists have a support shelf (127) running the length of each opposing side for the purpose of supporting a plurality of fiber cement corrugated sheets (130) that span the space between the joists. A shrinkage control mesh (140) is arranged atop the corrugated sheets and is oriented generally in the direction of the load-bearing members and the joists. A thin layer of concrete (150) is formed over the corrugated sheets and the shrinkage control mesh, to form a flat, horizontal floor surface (151). The load-bearing members and the joists are made of strong, lightweight materials, such as steel. The combination of the light-weight structural materials, the fiber cement corrugated sheets, and the thin concrete layer allows for a suspended concrete floor system that is easily constructed and that has a relatively wide span as compared to conventional suspended concrete floor systems.

19 Claims, 17 Drawing Sheets

Fig. 8A
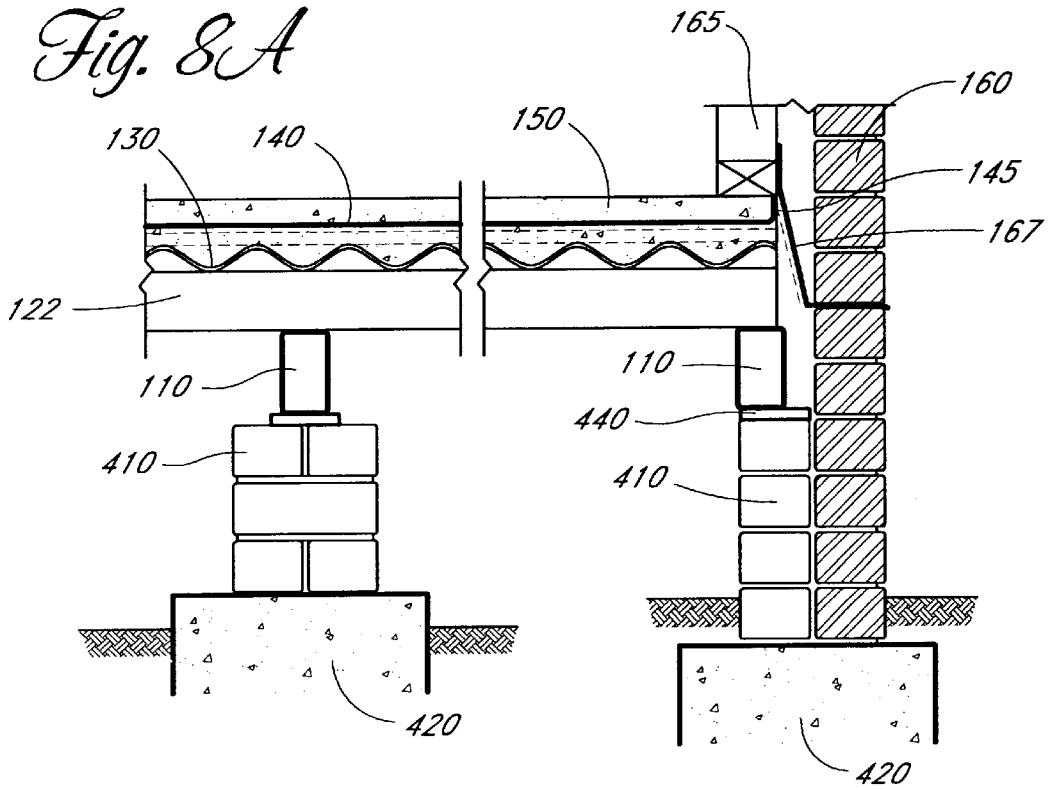
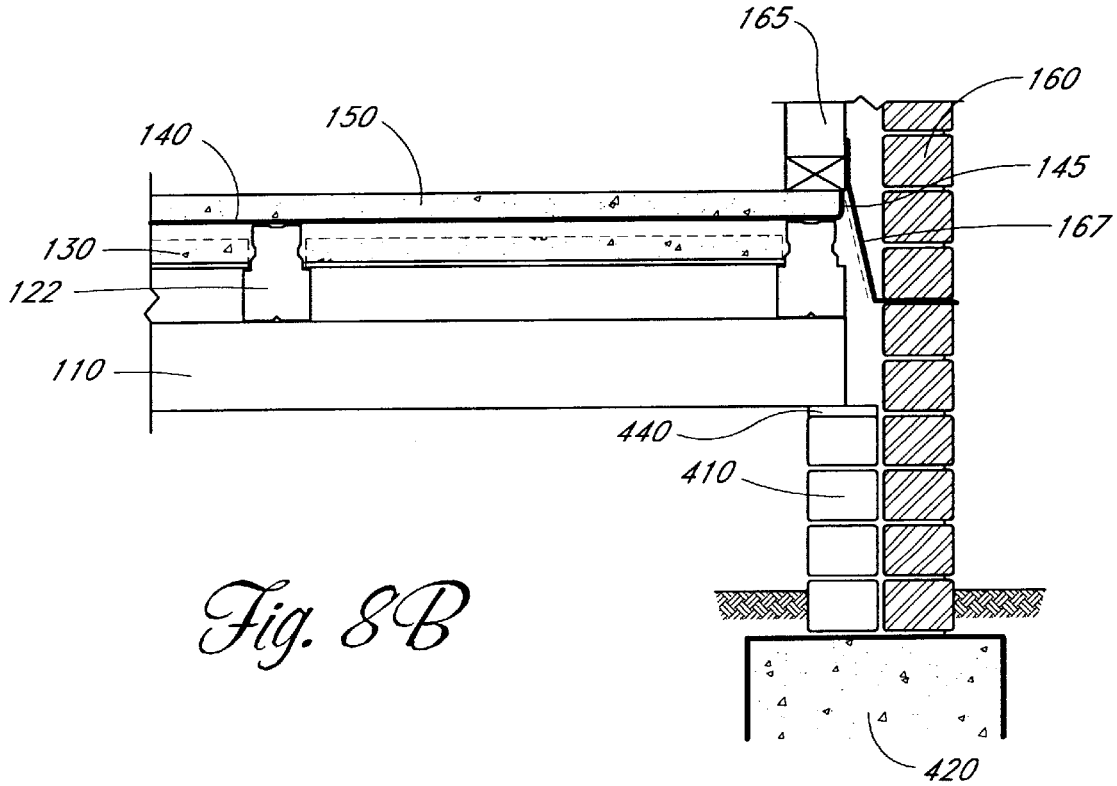
Fig. 8B

SUSPENDED CONCRETE FLOORING SYSTEM AND METHOD

RELATED APPLICATION

This invention claims priority from U.S. Provisional Application Serial No. 60/241,042, filed on Oct. 16, 2000, the entire disclosure of which is hereby incorporated by reference.

BACKGROUND OF THE INVENTION

1. Field of the Invention

The present invention relates to flooring systems, and in particular relates to suspended concrete flooring systems for use in residential and commercial construction projects.

2. Description of the Related Art

Suspended flooring systems are gaining popularity for both residential and commercial construction projects. This is increasingly true for projects on sloped construction sites. Traditionally, a sloped site must be leveled by cutting away a suitable area for a foundation, and then erecting substantial retaining shoring to uphold the surrounding terrain. This is often costly, and thus, suspended flooring systems offer an attractive alternative because the land does not have to be substantially altered before construction can begin.

Additionally, consumers have expressed a preference for concrete floors over wooden floors because of its smooth, flat surface that does not bow or warp, it is silent and does not squeak, it is fire resistant, and it is resistant to termite and water damage. Although consumers have expressed a preference for concrete flooring, many consumers are forced to settle on suspended floors constructed of wood because of its cost advantage over concrete suspended flooring. Generally, suspended concrete floors are both material and labor-intensive and are thus often cost prohibitive regardless of the construction technique.

There are currently a variety of construction techniques for producing suspended concrete floors for single and multi-story buildings. One such method of forming a floor in situ involves pouring concrete into an arranged formwork. In order for this type of floor to perform structurally, the concrete must be quite thick. This results in a floor that is very heavy and therefore requires a significant amount of formwork to hold the floor in place. Furthermore, the substantial amount of concrete results in a floor that is very expensive to install. One way of reducing the cost and weight considerations involves incorporating steel reinforcement into the floor to provide increased tensile strength which allows a thinner concrete slab. However, the substantial formwork necessary is labor intensive and usually makes this option cost prohibitive, especially for residential construction projects.

Another construction technique involves positioning pre-cast slabs or beams into an arranged framework. This method involves less supportwork than traditional poured floors; however, pre-cast slabs or beams are generally too heavy for manual installation and this technique often requires the use of heavy machinery, such as cranes, to position the heavy slabs into the framework, which makes construction projects on sloped construction sites problematic. Additionally, the slabs or beams must be poured and cured off-site and then hauled to the construction site. Not only are there additional costs associated with delivery of the slabs, but the additional handling of the cured slabs, (e.g. truck loading and unloading, lifting the slabs with a crane, positioning the slabs into the framework) presents opportunity for the slabs to become damaged.

Regardless of the construction technique used, an important consideration is the system used to support the concrete floor during construction. Generally, a concrete floor cannot go unsupported over a large span during construction because of its inherent relatively weak tensile strength. Therefore, a significant amount of underlying supportwork is often required to provide adequate structural support for the floor during construction. The installation of the supportwork, usually in the form of framework or formwork, in preparation for such a floor is a predominant component of the labor cost, and often makes large floors economically infeasible.

Accordingly, the ability to span a large area of floor with a minimum of supports during construction is a significant challenge in construction, and is a constant goal of suspended concrete flooring system design.

One approach to strengthening the cement, thus allowing it to span larger unsupported distances, is to incorporate fibers such as steel, asbestos, glass, or synthetics into the cement composite. Two commercially available reinforcing agents are asbestos and glass fibers. Asbestos is an important cement reinforcing material because of its chemical and thermal inertness, fibrous structure and high modulus of elasticity. However, health risks associated with the manufacture of asbestos-cement based materials have restricted their use in recent years. Asbestos-based cement composites also often exhibit brittle failure, while glass fiber reinforced cements are sensitive to age and curing, reducing the efficiency and desirability of these reinforcing agents.

Synthetic fibers are excellent alternatives to supplement or replace glass and asbestos fiber reinforcing agents. Acrylic fibers are one of the most important types of fibers as reinforcing agents for ambient-cured cement composites. These materials offer a high modulus of elasticity, good alkali resistance and good adhesion when properly oriented in a cement mix. Wet stretch, plastic stretch or heat-transfer fluid mediated stretching techniques assure fiber orientation in the composites, which is required for high modulus characteristics.

Fiber reinforcing a cement composite gives it the advantageous characteristics of higher tensile strength and a higher modulus of elasticity. These improved characteristics allow the cement to maintain its structural integrity over greater unsupported spans, achieve sufficient structural strength with less material, and offer a reduced cost option because less material is required. Accordingly, it would be advantageous to have a suspended concrete flooring system that takes advantage of the properties of fiber cement products to make such flooring systems more applicable to residential use. It would be a further advantage for a flooring system to combine the benefits of the above-mentioned flooring systems while eliminating the drawbacks of each.

SUMMARY OF THE PREFERRED EMBODIMENTS

The preferred embodiments disclosed herein solve the above-described problems by combining, among other things, the prior art methods of positioning pre-cast concrete slabs or beams and pouring a floor in situ. Specifically, a pre-cast floor has the benefit of requiring a minimal amount of supportwork, while the poured floor offers the benefits of creating a monolithic floor without the need for slab transportation and heavy machinery installation. This is accomplished by making use of a rigid framework supporting corrugated fiber cement sheets to provide an underlying support layer for a poured in situ concrete floor. The framework includes strong, lightweight load-bearing members or supporting walls and joists arranged so as to allow for a large floor span between supports.

The result is a monolithic concrete floor that is easily constructed, can be installed manually without the need for large machinery, and can span larger unsupported distances thus reducing the necessary framework, installation time, and labor cost.

A first aspect is a cement flooring system suspended above the ground either by a plurality of spaced-apart load-bearing members or supporting walls arranged substantially parallel to one another supported by traditional footings. The system further includes a plurality of spaced-apart joists having opposing sides and arranged at substantially right-angles to the load-bearing members or supporting walls and are supported thereby. Each joist, except perhaps for the outer joists, has a support shelf formed along the length of each opposing side. The system also includes a plurality of deck sheets supported between the joists by the support shelves so as to span the space between the joists in the horizontal plane defined by the support shelves and provide a substructure to receive the poured concrete. In one embodiment, the deck sheets are corrugated fiber cement sheets. A shrinkage control mesh is arranged atop the joists and is oriented in the directions of the load-bearing members and the joists. A concrete topping layer is poured atop the corrugated fiber cement sheets and encompasses the shrinkage control mesh. The concrete topping layer is formed to have a flat, horizontal upper surface that serves as a floor.

A second aspect is a method of installing a concrete flooring system suspended above the ground in which a plurality of footings have been previously installed. The method includes the step of first arranging a corresponding pier on each of the footings. The second step involves positioning and securing a plurality of load-bearing members atop the piers. Alternatively to piers and load bearing members, support for the joists can be in the form of supporting walls, such as masonry walls. The third step comprises positioning and securing a plurality of spaced apart joists to the plurality of load-bearing members or supporting walls at substantially right angles so that the joists are supported by the load-bearing members or supporting walls and define a space for receiving the fiber cement corrugated sheets. The fourth step includes placing a plurality of fiber cement corrugated sheets in the space between the joists so as to be supported in a horizontal plane by the joists and to span the space between the joists. The fifth step involves arranging a shrinkage control mesh atop the joists in orientation with the load-bearing members and the joists. The final step includes pouring concrete over the corrugated sheets so as to encompass the shrinkage control mesh and to form a flat horizontal floor surface.

BRIEF DESCRIPTION OF THE DRAWINGS

FIG. 8*a* is a cross-sectional diagram of the suspended concrete flooring system showing an external wall detail.

FIG. 8*b* is a cross-sectional diagram of the suspended concrete flooring system showing an external wall detail from a view orthogonal to that of FIG. 8*a*.

DETAILED DESCRIPTION OF THE PREFERRED EMBODIMENTS

The present invention is now described with respect to certain preferred embodiments and with reference to the attached drawings.

Figure 1:
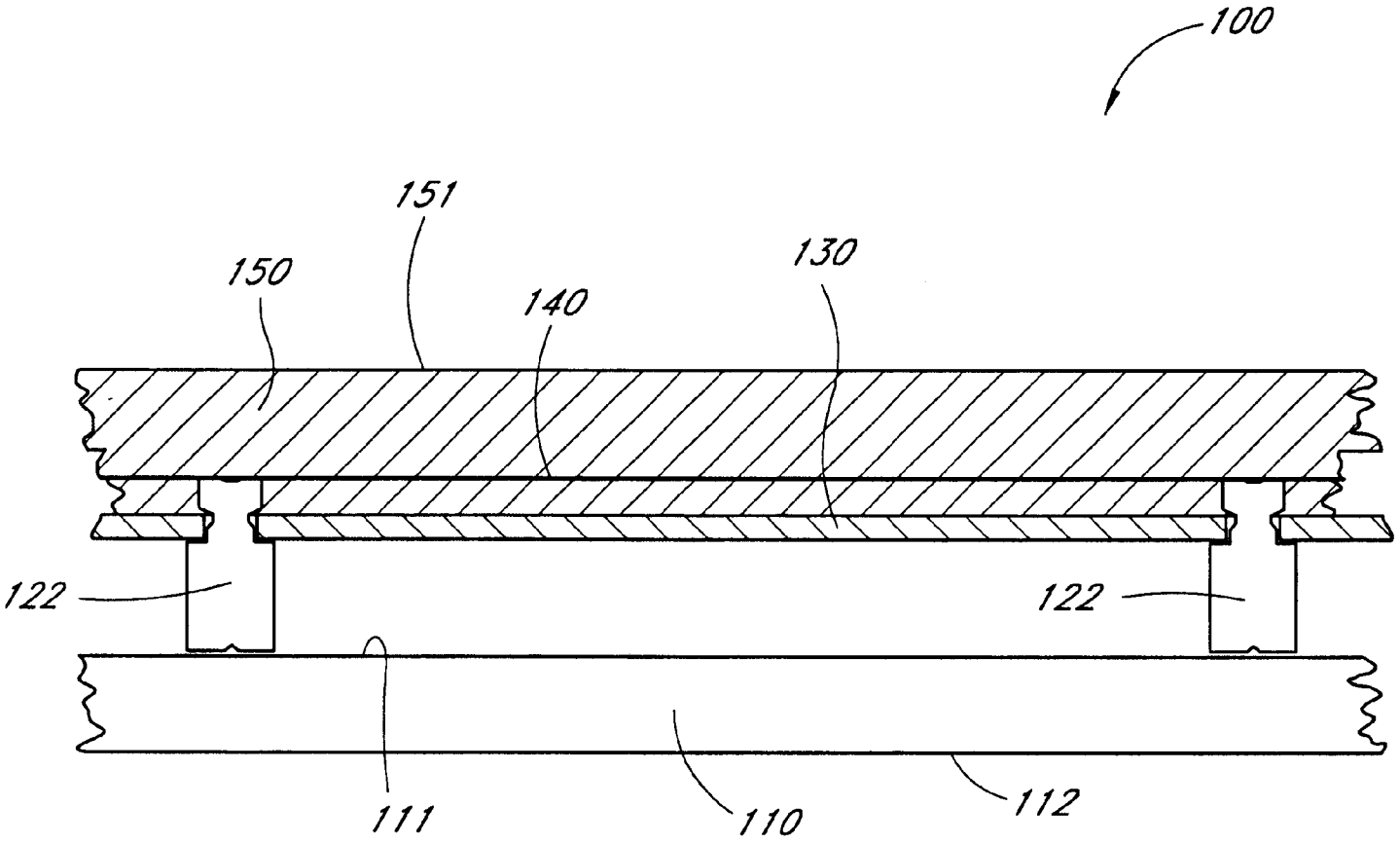
FIG. 1 is a cross-sectional diagram of a suspended concrete flooring system according to one embodiment of the present invention.
Figure 2:
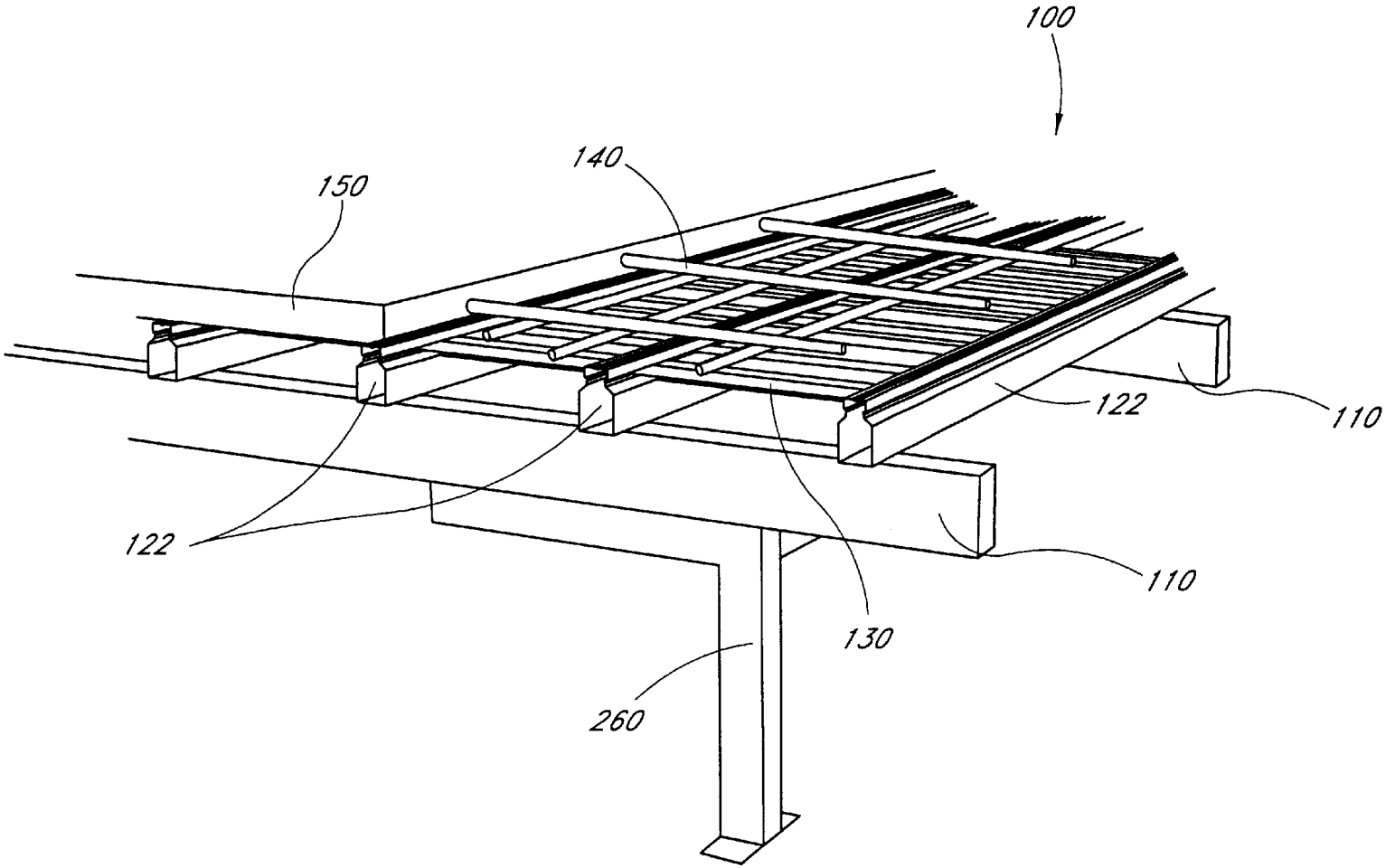
FIG. 2 is a perspective cut-away view of the flooring system of FIG. 1, showing a steel post pier supporting the floor, and also showing the shrinkage control mesh.

With reference to FIGS. 1 and 2, there is shown a suspended concrete flooring system 100 that includes two or more horizontally arranged elongate load-bearing members 110 each having an upper surface 111 and a lower surface 112. Bearing member 110 is preferably constructed of metal, such as 2.5 mm gauge, galvanized, rectangular hollow section (RHS), but any suitable material and configuration, including the use of supporting masonry walls, may be used as a bearing member for the joists as long as it demonstrates the requisite structural properties. One such example of a suitable bearing member 110 is SupaGal® RHS Bearer, sold by James Hardie Building Products, Inc., Rosehill, NSW, Australia. Bearing member 110 is typically installed on a pier or support post 260 (FIG. 2).

Upper surface 111 of bearing member 110 supports two or more elongate joists 122, arranged perpendicular to the bearing member 110 and spaced apart so that the bearing members and joists form a support grid. The arrangement of joists 122 relative to bearing members 110 is discussed in greater detail below. Before greater discussion of the system, it becomes necessary to describe the joist 122 in relation to FIG. 3. Each joist 122 has an upper surface 123, a lower surface 124, and opposing sides 125. Opposing sides 125 each have a rebate 126 with a shelf portion 127 formed along the entire length of the joist 122 near upper surface 123. Rebate 126 and shelf 127 are designed to engage and support the edges of a deck sheet 130, as discussed below. Shelves 127 define a horizontal plane to be spanned by the deck sheets.

Figure 3:
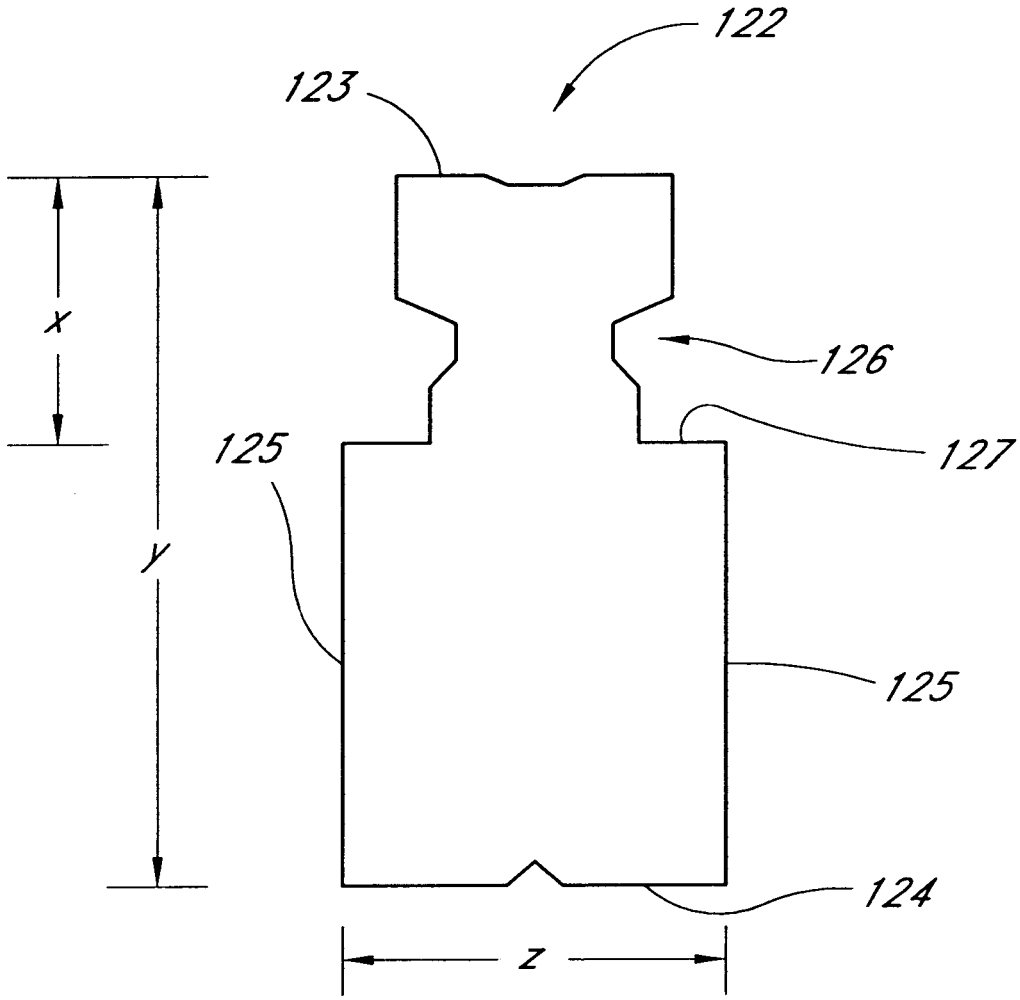
FIG. 3 is a cross-sectional diagram of a joist used in the flooring system in one embodiment of the present invention, showing the rebate and shelf used to support and secure the corrugated sheets shown in FIG. 4.

With continuing reference to FIG. 3, joist 122 has measurements "x", "y", and "z." Length "x" is a fixed distance from upper surface 123 to shelf 127 formed on sides 125, and in one embodiment, is preferably about 60 mm. Depth "y" is preferably about 150 mm in one embodiment. For a joist 122 with y=150 mm, the corresponding maximum length is 4.2 meters. In one embodiment, width "z" preferably is about 110 mm. Joists 122 are preferably constructed of metal, such as high strength, galvanized, roll-formed steel, and are preferably fastened to bearing members 110 via self-drilling screws. One such joist 122 is the Hardifloor™ Joist, sold by James Hardie Building Products, Inc., Rosehill, NSW, Australia. The dimensions given are illustrative of one embodiment of the invention, and notably, other configurations of the Hardifloor™ Joist are presently available. Other dimension are easily calculable based on the joists 122 and bearing members 110 used.

Figure 4:
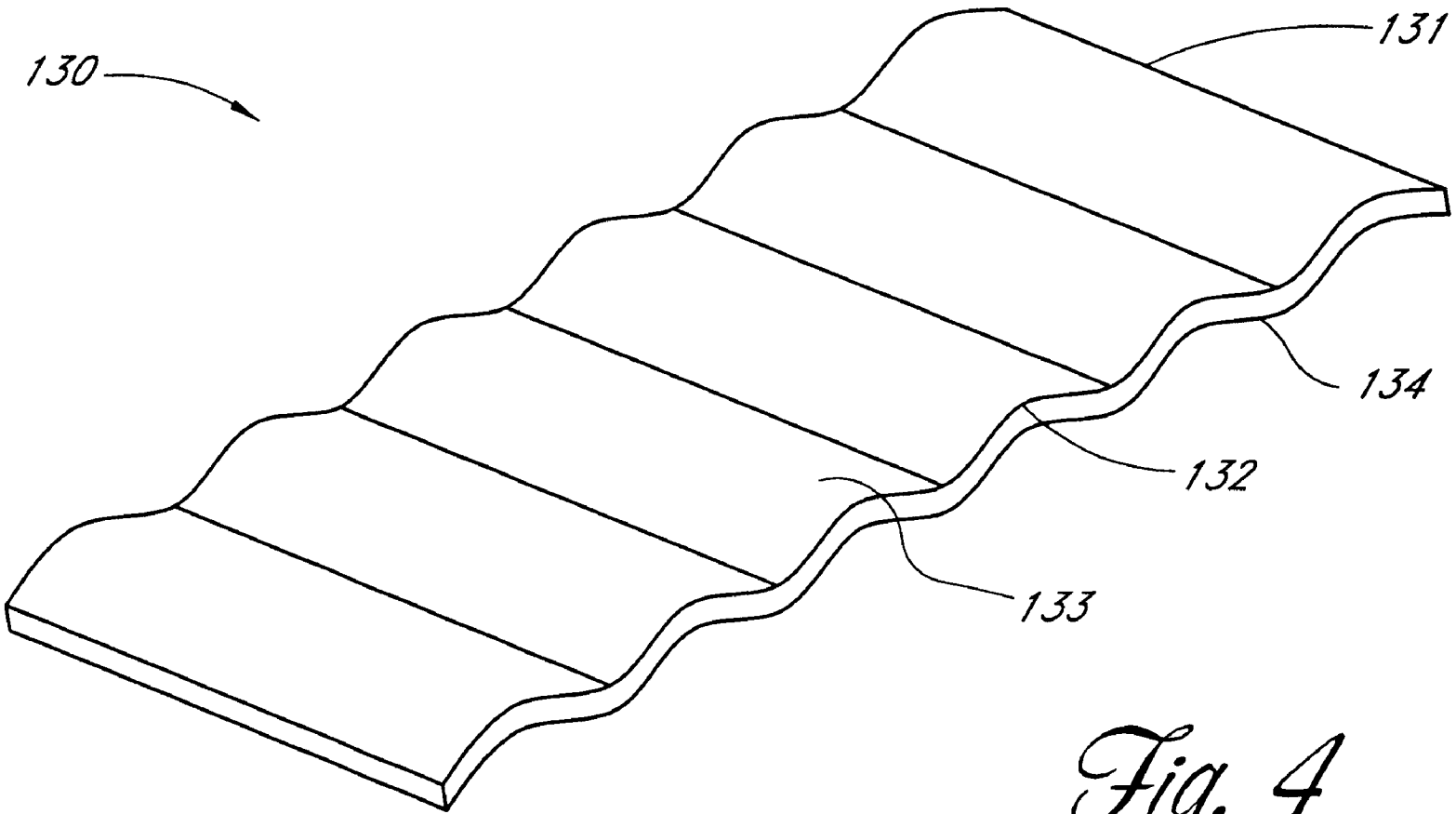
FIG. 4 is a perspective view of a corrugated sheet used in one embodiment of the present invention.

Before returning to the system description of FIGS. 1 and 2, one embodiment of a deck sheet, the corrugated fiber cement sheet 130, must first be discussed. Referencing FIG. 4, system 100 further includes a plurality of deck sheets 130. In one embodiment, these deck sheets are corrugated fiber cement sheets having ends 131 and edges 132, an upper surface 133 and a lower surface 134. Sheets 130 are arranged between joists 122 such that edges 132 fit within rebates 126, with lower surface 134 at edges 132 supported by shelf 127. Sheets 130 are thus arranged to span the space between the joists and are in a horizontal plane defined by shelves 127. Sheets 130 are designed to be high-strength and highly impact resistant, even when exposed to moisture. An exemplary sheet 130 is JH Super 6 corrugated fiber cement sheet, sold under the trade name Hardiform™ Corrugate made by James Hardie Building Products, Inc., Rosehill, NSW, Australia. The JH Super 6 sheet has dimensions W=750 mm, L=1080 mm, and H=50 mm. Thus, in one embodiment of the present invention using the JH Super 6 sheet 130, the spacing between joists 122 is about 825 mm. However, other sheet dimensions could be used. The disclosed dimensions are based upon the corrugated sheet's strength in supporting wet concrete and other construction loads. Therefore, in contemplating other types of deck sheets, the dimensions and spacing of the joists may change as allowable by the deck sheet strength requirements. Furthermore, other types of sheets may be interposed between the joists for a deck layer to support poured concrete. These may include flat fiber cement sheets, composite panels, or extruded panels of various shapes and densities.

Returning to FIG. 1, arranged atop joists 122 is a shrinkage-control mesh 140 made up of a cross-grid of metal rods, preferably steel of F62 or F72. The designations F62 and F72 are descriptive codes, referring to characteristics of the mesh. For example, F72 refers to steel mesh fabric having 7 mm diameter bars at 200 mm centers. Shrinkage control mesh 140 is laid such that the mesh grid is generally oriented in the directions of bearing members 110 and joists 122, thus providing added concrete tensional strength as well as shrinkage control. A concrete topping layer 150 having a floor surface 151 is poured on top of mesh 140 and sheets 130. Concrete topping layer 150 is finished to form a smooth, horizontal concrete slab surface as required. Concrete topping layer 150 is a standard pre-mixed concrete, and in one embodiment, is mixed to achieve a 28-day cured strength of about 20 MPa. Concrete topping layer 150 is applied in a slump to encompass mesh 140 and to preferably have a thickness between about 75 and 105 mm when smooth. Because of this thickness compared with traditional poured floors, only a minimum of formwork is required to install flooring system 100.

FIG. 2 shows additional features of a suspended concrete flooring system 100. Not shown in this figure is a plurality of footings poured into the ground to provide a solid base for the flooring system 100. Mounted atop the footings are piers 260 arranged so as to support the floor at predetermined locations. Each pier 260 provides support for the bearing members 110 mounted thereon. The bearing members, in turn, provide support for the plurality of joists 122. As described above, each joist 122 is provided with a rebate 126 into which corrugated fiber cement sheets 130 are inserted and supported by shelf 127. In this way, the joists 122 and sheets 130 provide the necessary formwork for receiving the poured concrete. A shrinkage control mesh 140 is placed on top of the joists 122 so that when the concrete is poured, the mesh 140 is encompassed by the concrete 150 and provides increased tensional strength in addition to shrinkage control.

Figure 5:
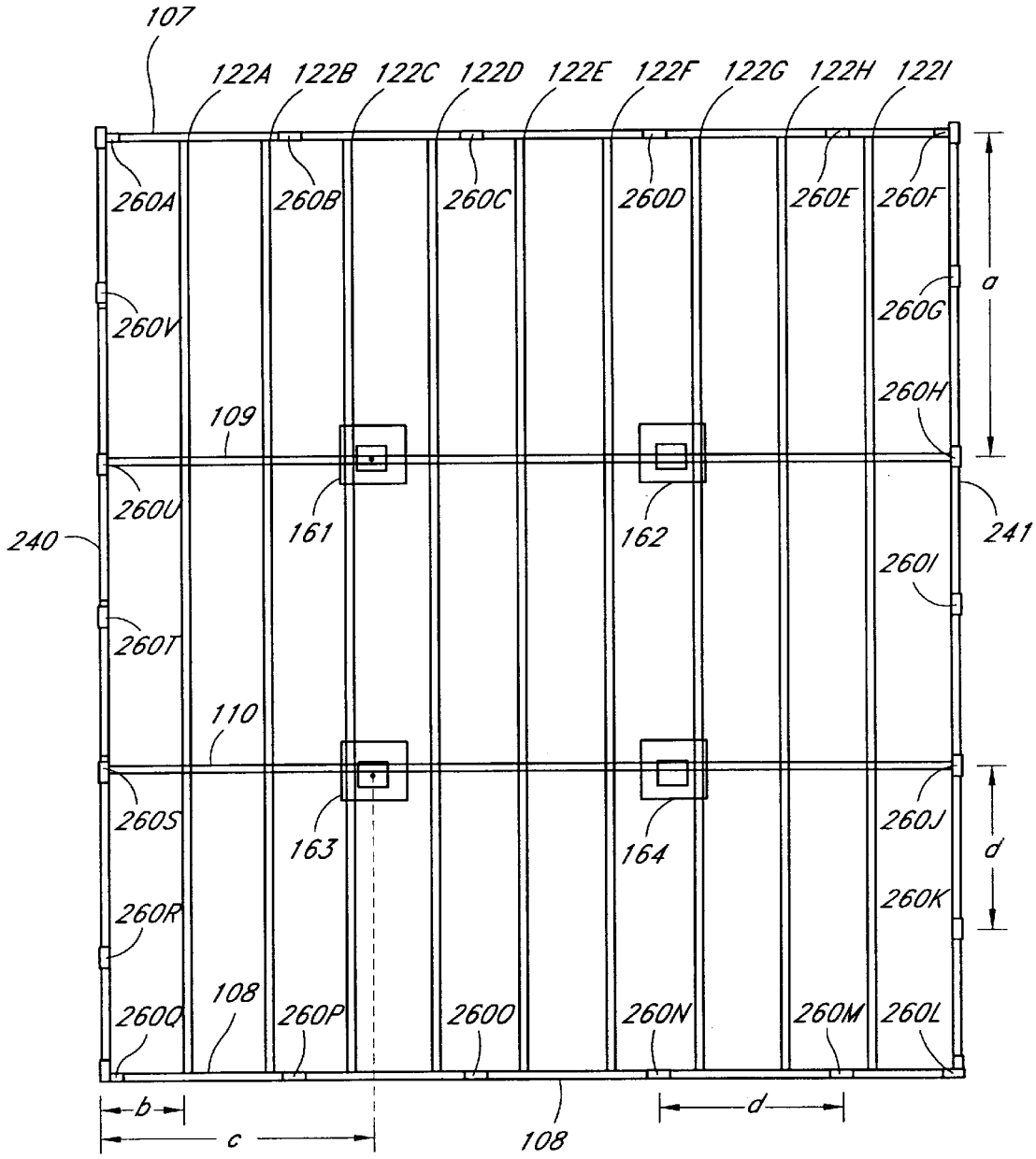
FIG. 5 is a plan view of an embodiment of a flooring system without the corrugated sheets installed, showing the location of the supporting piers, and the approximate relative dimensions and arrangement of the bearing members and joists.

FIG. 5 shows a plan view of one arrangement of a suspended concrete flooring system 100. Joists 122A–122I are laid parallel to each other atop bearing members 110, and are spaced apart by length "b". In one embodiment, it has been demonstrated that when "b"=825 mm, 2 kPa design Live Load is supportable. In other embodiments, the spacing of bearing members 110 may be increased or reduced depending on the application and the magnitude of contemplated loads to be supported. As shown in FIG. 5, joists 122 are laid substantially perpendicular to bearing members 107, 108, 109, and 110 and are fastened to the bearing members with self-drilling screws, as is generally known in the art. Bearing members are preferably spaced apart at intervals of length "a." In one embodiment, length "a" is equal to about 3600 mm. In another embodiment utilizing a 150 mm joist, length "a" may be equal to about 4200 mm. The spacing "a" of the bearing members is controlled by the structural properties of the joists 122. Therefore, joists 122 with greater rigidity and bending strength may be supported at distances longer than described herein. Likewise, the spacing "d" of the piers 260 is a function of the bearing members used in the construction project. The stronger the bearing member, the farther the allowable spacing between the piers 260.

Bearing members are supported by piers 161–164. First pier 161 and second pier 162 are located under a first internal bearing member 109, while second and third posts 163 and 164 are located under a second bearing member. Length "c" defines the distance between a first wall 240 and piers 161 and 163. In one embodiment, length "c" is equal to about 2000 mm. Length "c" also defines the length between first pier 161 and second pier 162, and similarly, is the distance between third pier 163 and fourth pier 164. As noted above, this distance is dependent upon the physical characteristics of the bearing members, and is calculated based upon the material and configuration of the bearing member. The recited dimensions are exemplary and do not limit the spacing contemplated herein.

Along the perimeter of outer first external bearing member 107, first wall 240, second external bearing member 108, and second wall 241, are engaged piers 260 (e.g., 260A–260V), described in greater detail below. Piers 260 are spaced at intervals of length "d," calculated to provide sufficient load bearing capability while preserving as large a span as possible with the given thicknesses and materials selected for the construction project.

Figure 6:
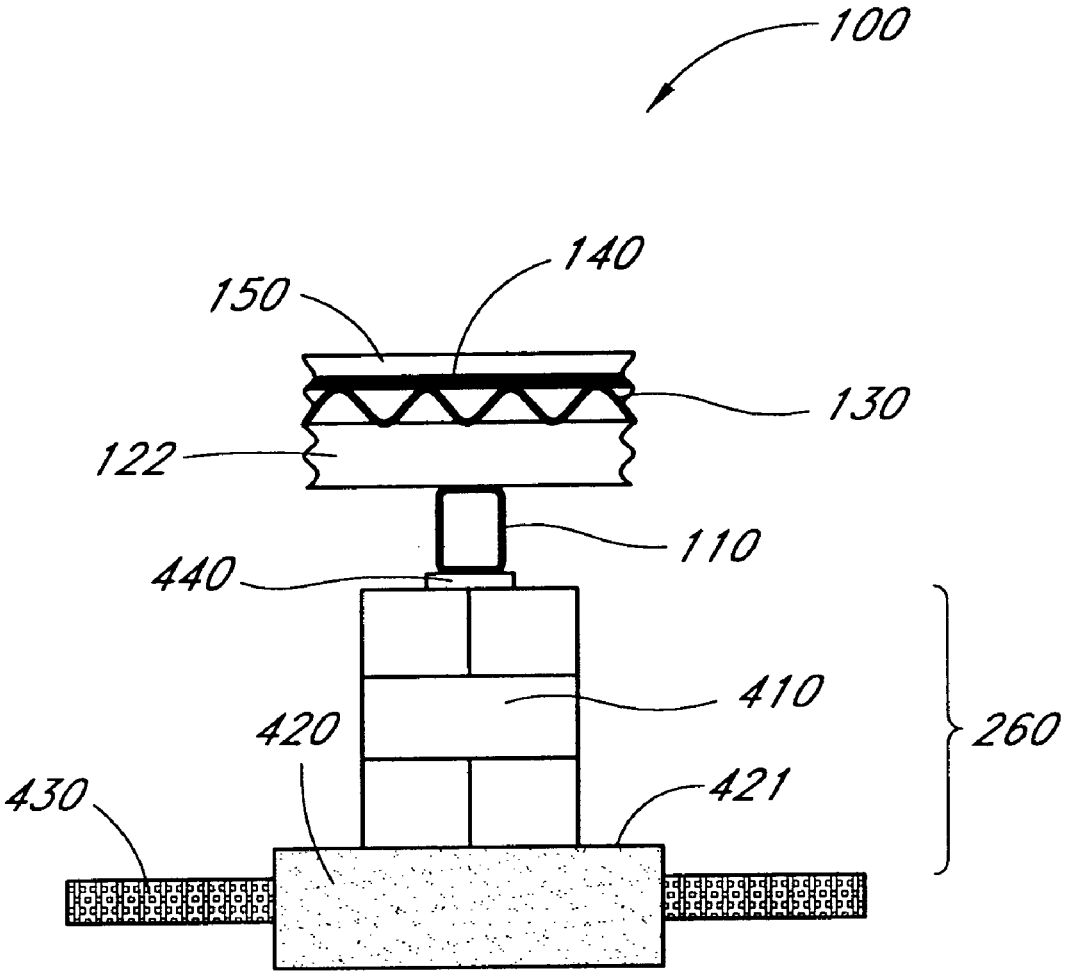
FIG. 6 is a cross-sectional diagram of a masonry-type pier suitable for use in one embodiment of the present invention, along with the footing installed in the ground to support the pier.

FIG. 6 shows a portion of flooring system 100 that illustrates one embodiment of a pier 260 for supporting a load-bearing member 110 and floor system 100 as a whole. A footing 420 is formed in the ground and has an upper surface 421 on which rests support column 410, as is generally known in the art. Footings 420 are preferably made of concrete, and are constructed by the builder in specified locations prior to construction of the flooring system 100, based on the predetermined design of the flooring system 100. Support column 410 may be a brick pier, as shown in FIG. 6, or may be an adjustable steel post system as shown in FIG. 2. Pier 260 further includes packing 440 placed between bearing member 110 and a support column 410 to position bearing member 110 at a predetermined elevation. Packing 440 may be made of compressed fiber cement, or any other material providing sufficient support with minimal compression. Each pier 260 has a predetermined height in accordance with the particular design of floor system 100 and the elevation of the ground 430. This system is especially practical in situations where the ground 430 is uneven, and therefore, each pier 260 may have a different length to achieve a horizontal flooring surface. Additionally, it is sometimes desirable to have floors at separate elevations from one another, for example, in a garage, or sunken room, which require the supporting piers 260 to have different heights.

Each component of flooring system 100 may be easily handled and installed by construction workers without the use of heavy lifting equipment. Because heavy equipment is not required, the embodiments of the present invention may be used in locations where conventional concrete laying cannot be used, such as sloped building sites. The strength of the suspended concrete flooring system has been measured to be greater than the sum of its component strengths, and as a result, provides a flooring system that provides all the strength advantages of an on slab concrete floor while utilizing much less concrete.

Figure 7A:
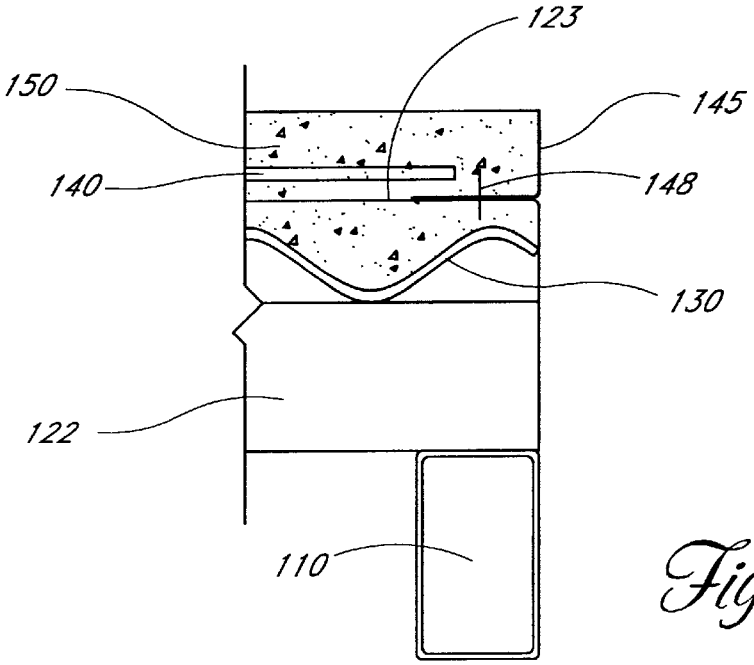
FIG. 7*a* is a cross-sectional diagram of a suspended concrete flooring system showing an edge detail.
Figure 7B:
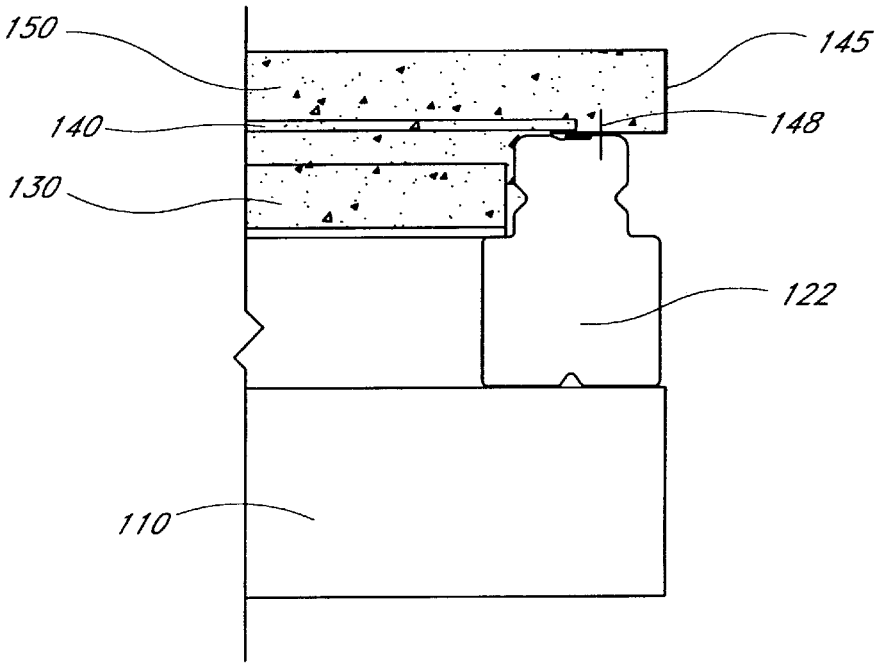
FIG. 7*b* is a cross-sectional diagram of a suspended concrete flooring system showing an edge detail from a view orthogonal to that of FIG. 7*a*.

FIGS. 7*a* and 7*b* show one embodiment of an edge detail of the flooring system 100. As has been described, the bearing member 110 is supported on a pier (not shown). A plurality of joists 122 are arranged on the bearing members 110 to form a supporting grid for the concrete. A plurality of supporting deck sheets, such as corrugated fiber cement sheets 130, are inserted into the rebates formed in the joists 122 to create a horizontal surface for supporting the poured concrete. A shrinkage control mesh 140 is placed on top of the joists 122. To provide a form around the periphery of the formwork to retain the poured concrete, an edge angle 145 is mounted to the joists 122 around the periphery of the floor with self-drilling screws. The poured concrete is poured onto the corrugated fiber cement sheets and bounded by the edge angles 145 around the periphery of the floor.

FIGS. 8*a* and 8*b* show one embodiment of a flooring system adjacent to an exterior wall of the building. Footings are first formed in the ground as is generally known in the art. Piers 410 are erected on top of the footings, which provide support for the bearing members 110. Alternatively, the joists 122 may be supported directly by the pier 410, or by a supporting wall. Fastened to the top of the bearing members 110 are joists 122, separated from the bearing members 110 by packing 440. The packing 440 is ideally compressed fiber cement and allows small elevational adjustments of the piers before installing the bearing members onto the piers. The use of packing 440 ensures that the finished floor will be level, even if the piers are not exactly the same height.

Deck sheets 130 are supported by the shelves of the joists 122 and provide a supporting platform to receive the poured concrete. A shrinkage control mesh 140 is placed atop the joists 122, after which edge angles 145 are fastened to the joists around the periphery of the floor to provide a boundary for the poured concrete. According to traditional building methods, a flashing and termite barrier 167 may be installed by the builder along outer walls 160 of the structure. Piers 410 along the outer periphery of the flooring system are termed engaged piers and provide adequate support for the flooring system as well as any bearing walls or other structure built on top of them. Engaged piers 410 are more numerous than point load piers because they are the supporting structure for the entire building structure, while point load piers serve to support only one location along the flooring system.

Method of Installing the Flooring System

Figure 9:
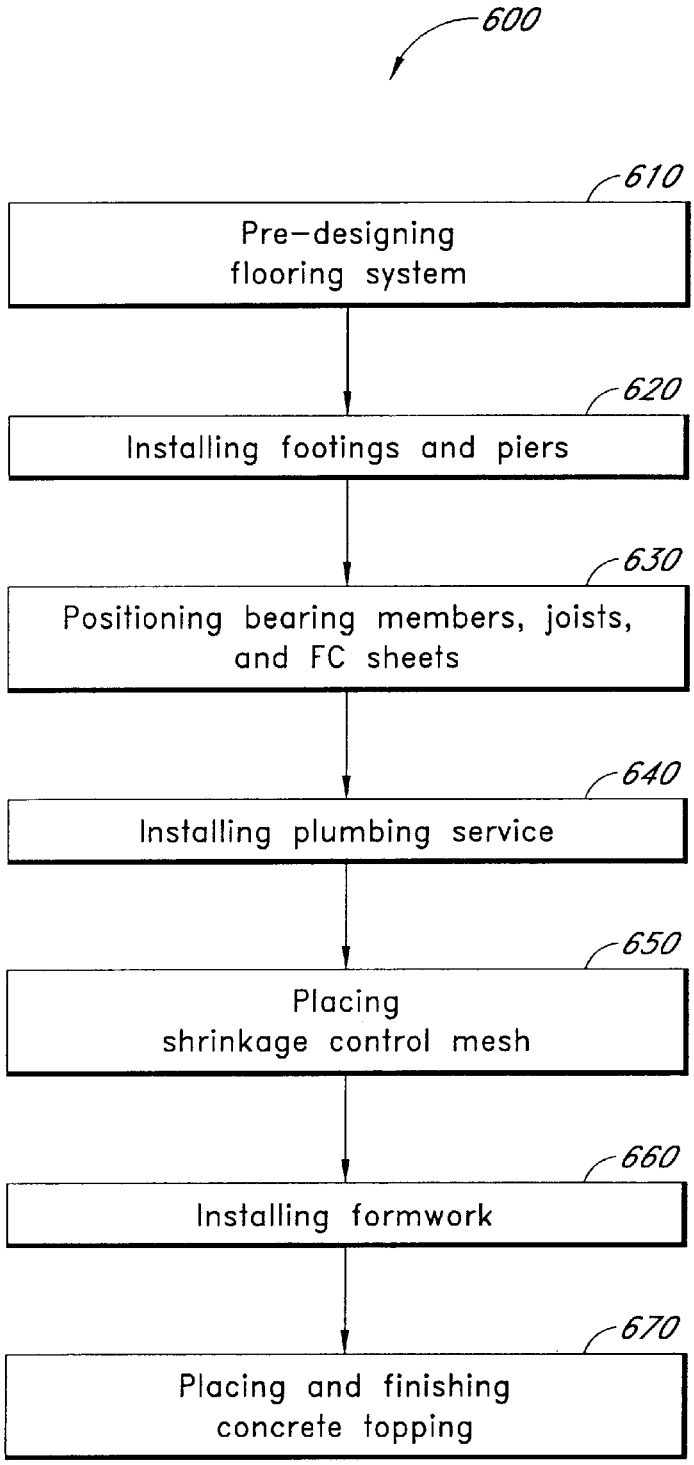
FIG. 9 is a flow diagram of the steps associated with installing the flooring system in one embodiment of the present invention.

With reference now to FIG. 9 and flow chart 600, one method of installing flooring system 100 is now described.

Step 610: Pre-designing suspended concrete flooring system

In this step, designers use a computer program to calculate the required number of piers, bearing members, and joists, and to create a design and blueprint to be used for a specific suspended concrete flooring system.

Step 620: Installing footings and piers

The builder installs strip footings, perimeter face brick walls and engaged piers to required height, and isolated piers (such as masonry or steel post piers) by conventional methods per the design. The footings required to support the piers will already have been installed by the builder.

Step 630: Positioning bearing members, joists, and corrugated fiber cement sheets The bearing members are positioned and fixed across engaged piers. After the bearing member installation is complete, the joists are positioned and fixed to bearing members preferably with self-drilling screws. Following joist installation, the deck sheets are positioned in the joist rebates and span the distance between joists.

Step 640: Installing plumbing services

A plumber (typically engaged by the builder) installs plumbing services through the deck sheets. Holes may be made in the deck sheets for receiving plumbing services by striking it with a hammer, by drilling, or other known techniques.

Step 650: Placing shrinkage control mesh

In this step, the shrinkage control mesh is placed over the joists and deck sheets.

Step 660: Installing formwork

A minimal amount of formwork, primarily edge angles, is installed around the perimeter of the suspended concrete flooring system, and in any set down locations to create a bounded volume prior to concrete pouring.

Step 670: Placing and finishing concrete topping

Pre-mixed concrete is poured onto the corrugated sheets and over the shrinkage control mesh, and is floated to an in-situ finish, thereby forming a flat, horizontal floor surface. After 24 hours, the floor supports walking; after one week, the floor may be worked upon to continue construction. In one embodiment, the suspended concrete flooring system is considered fully cured after 28 days.

In a multiple-story building, the flooring system underside may be finished in any traditional method, such as installing battens to the bearing members and attaching plasterboard sheets thereon.

It should be noted that not all the above-mentioned steps may be necessary to create a suspended flooring system according to the suspended concrete flooring system claimed herein. Additionally, the above steps may be performed in a different order and still result in the suspended flooring described and claimed herein.

Figure 10A:
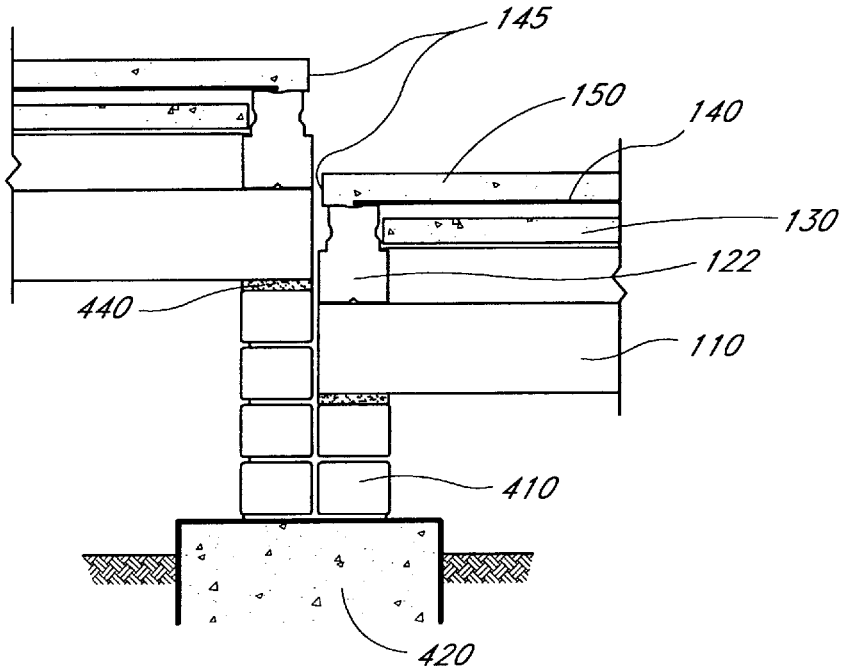
FIG. 10*a* is an internal set down detail on a ground floor level.
Figure 10B:
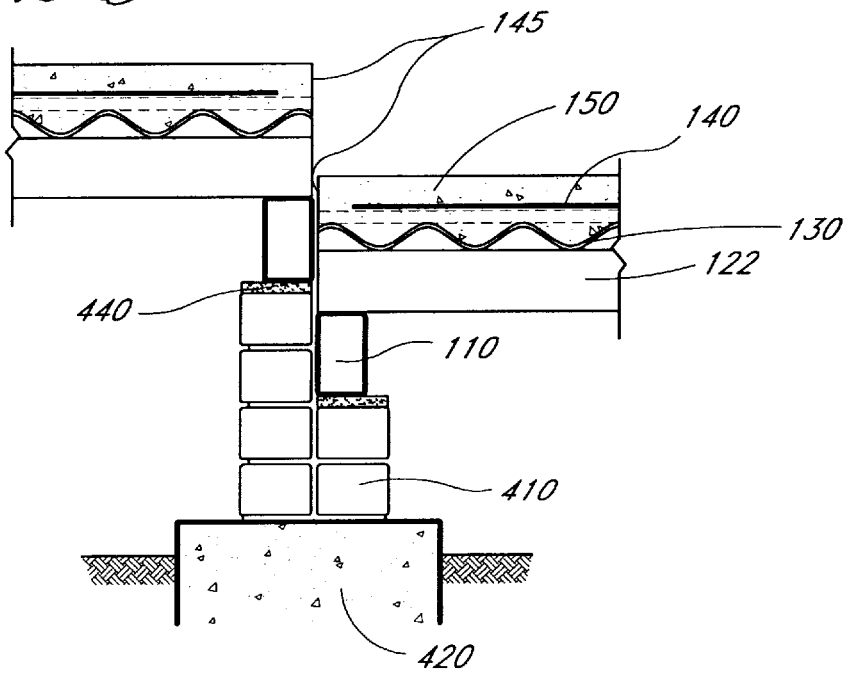
FIG. 10*b* is a view of an internal set down detain on a ground floor level from a view orthogonal to that of FIG. 10*a*.

FIGS. 10*a* and 10*b* show additional details regarding a typical internal set down. By varying the height of brick piers 410, a set down is created. Examples of this type of set down are to create a "sunken" room or a "raised" floor. The degree of set down is determined by the height difference in adjacent piers 410.

Figure 11A:
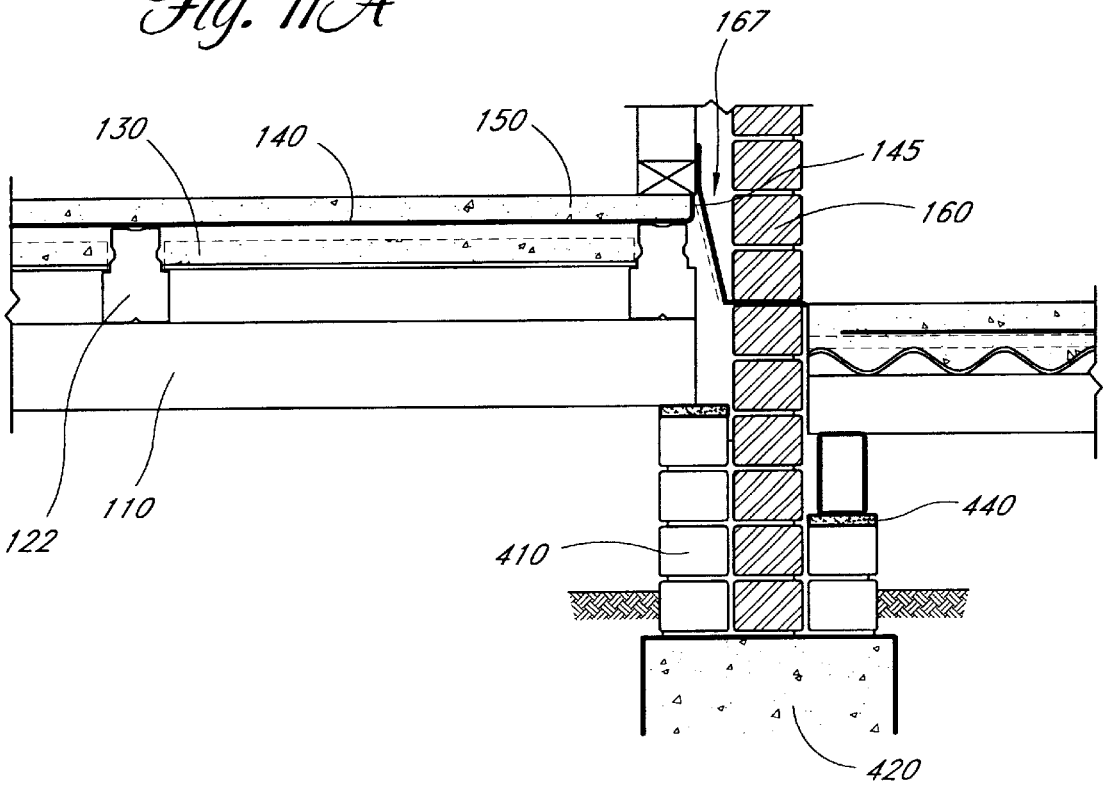
FIG. 11*a* is one embodiment of an external set down detail.
Figure 11B:
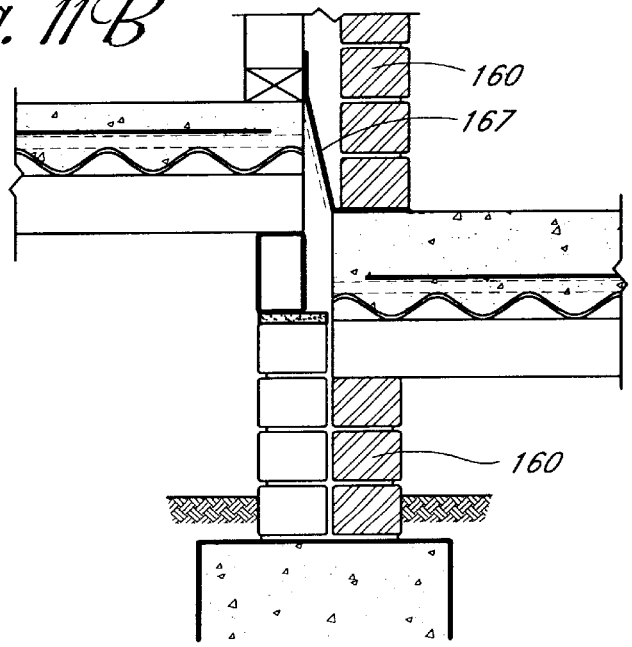
FIG. 11*b* is another embodiment of an external set down detail.

FIGS. 11*a* and 11*b* show details for creating an external set down. The interior floor is separated from the exterior by an outer wall 160, which may be of any traditional construction technique. The exterior wall may be directly supported on a footing 420, as shown in figure 11*a*, or may be supported by the concrete floor, according to FIG. 11*b*. Additionally, as shown, the bearing member may be omitted and the joist can be supported directly by a supporting wall 160. This construction detail may be implemented for creating an external floor, such as for a patio.

Figure 12A:
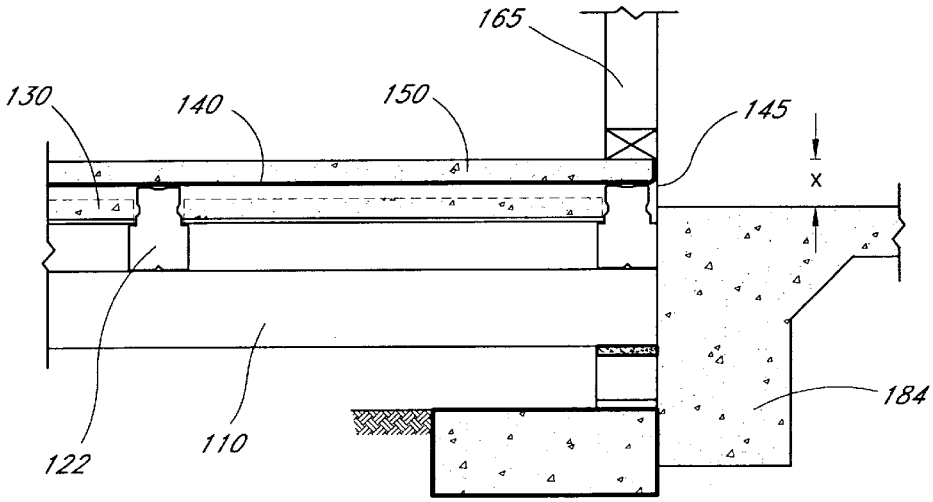
FIG. 12*a* is one embodiment showing a garage slab set down.
Figure 12B:
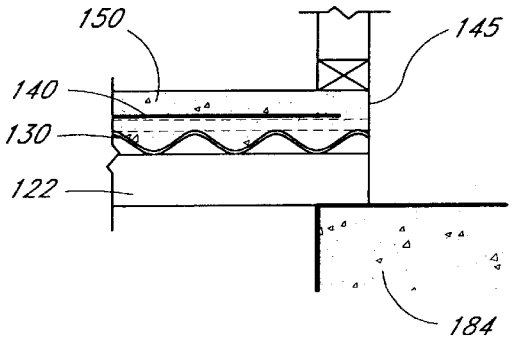
FIG. 12*b* is another embodiment showing a garage slab set down detail.
Figure 12C:
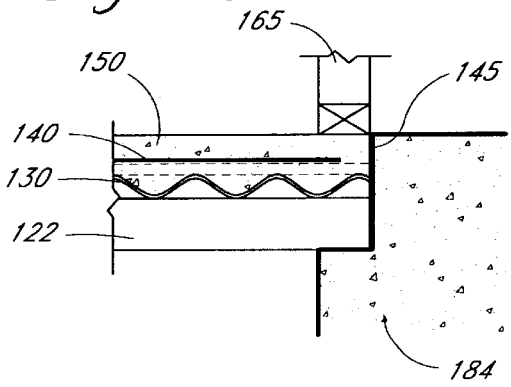
FIG. 12*c* is yet another embodiment showing a garage slab set down detail.

FIGS. 12*a* through 12*c* show various options for creating a garage slab 184. FIG. 12*a*shows one arrangement for creating a garage slab 184 set down. This is formed by pouring the garage slab independent of the suspended concrete flooring system in a traditional manner. Because a garage slab 184 is intended to support loads greater than an interior concrete floor, the garage slab 184 is usually much thicker than an interior slab, and is preferably a slab on ground, which allows the garage slab 184 to have the added support of the underlying ground.

FIG. 12*b* illustrates how a slab on ground garage floor 184 can be used as a supporting structure for an interior floor. By forming the garage slab 184 first, a suspended floor can subsequently be constructed on top of the garage slab 184. Notably, a bearing member is not required, as the joist 122 is supported directly by the garage slab 184. This creates a set down for the garage slab 184 below the interior floor.

FIG. 12*c* illustrates another embodiment for creating a set down garage slab 184. This construction technique utilizes a shelf formed in the garage slab 184 for supporting the joists 122. In this edge detail, a bearing member is not required since the garage slab 184 provides the necessary support along this periphery of the interior floor. The set down is optional by varying the thickness of the garage slab 184 as desired.

Figure 13A:
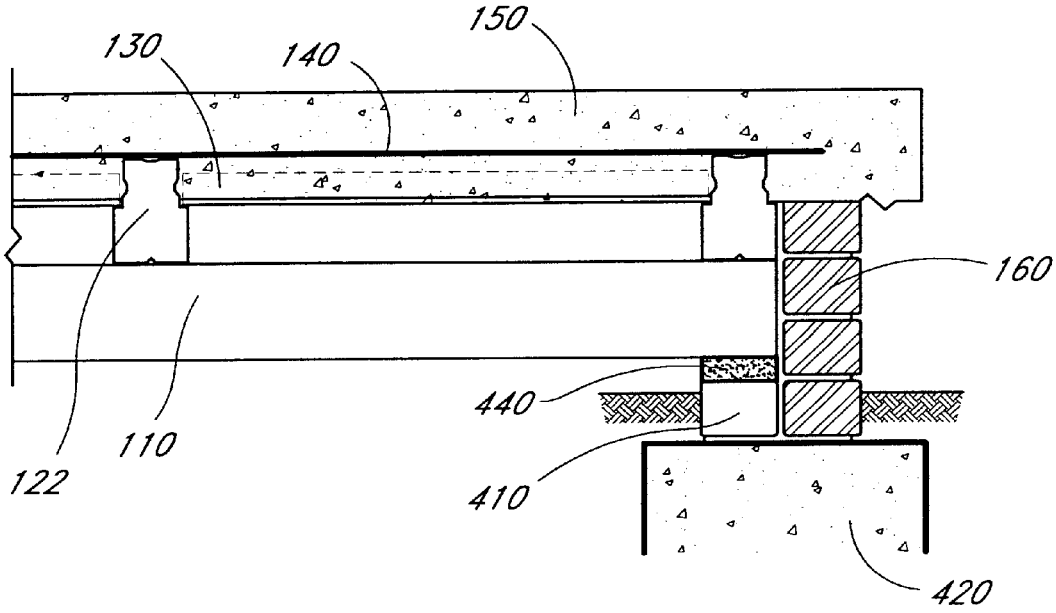
FIG. 13*a* is one embodiment of a verandah edge detail.
Figure 13B:
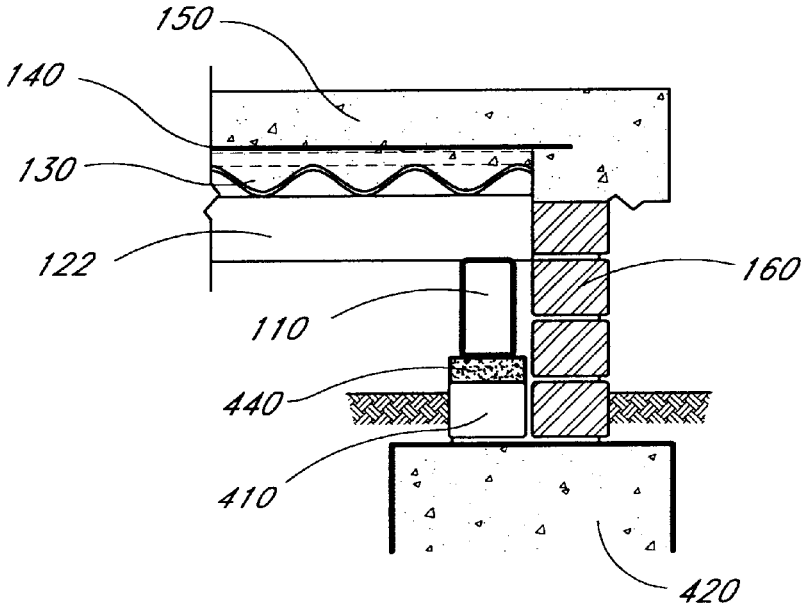
FIG. 13*b* is another embodiment of a verandah edge detail.

FIGS. 13*a* and 13*b* show one embodiment for creating a verandah edge. An external wall 160 provide support for the concrete layer 150. To create this type of edge, traditional formwork is required to create a bounded volume for containing the poured concrete until cured. Additionally, in viewing FIG. 13*b*, it should be apparent that bearing member 110 could be omitted joist 122 could extend to, and be supported by, the supporting wall 160.

Figure 14A:
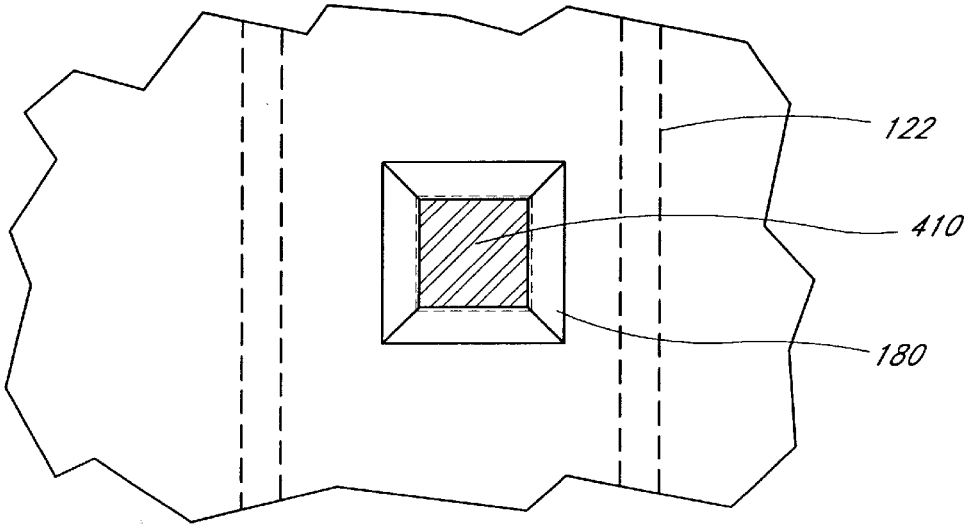
FIG. 14*a* shows a plan view of a point load detail.
Figure 14B:
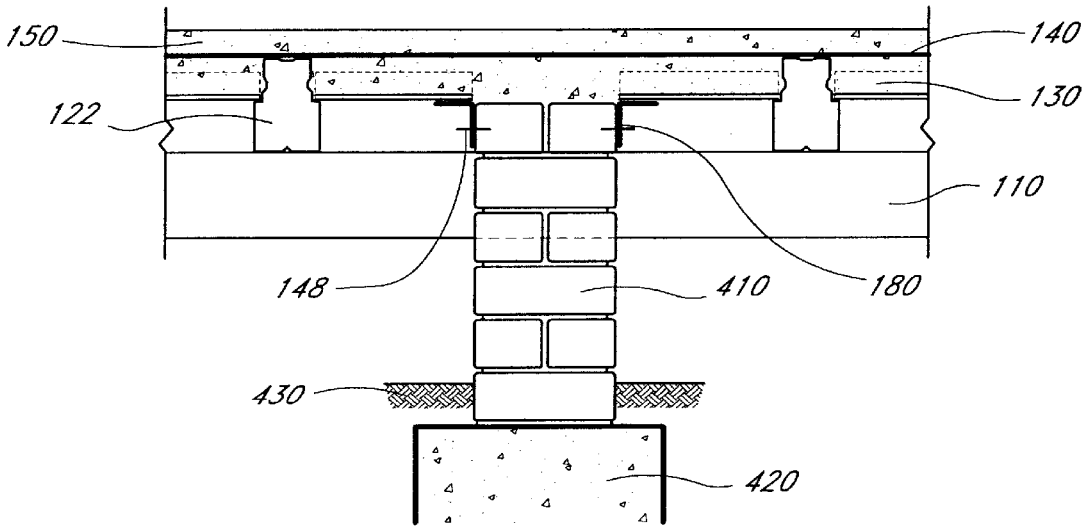
FIG. 14*b* is a cross-sectional view of the point load detail of FIG. 14*a*.

FIGS. 14*a* and 14*b* show one embodiment for forming a point-load pier for providing additional support at a discrete location along a suspended concrete floor. A traditional footing 420 is provided to support a pier 410, which may be any suitable pier. Edge angles 180 are affixed to the pier 410 by self-drilling screws 148 and provide a supporting shelf for the deck sheets 130. The deck sheets 130 are placed to allow the pier 410 to protrude therethrough. As the concrete topping layer 150 is poured, it rests directly upon the point load pier 410. In this way, the pier 410 provides increased support to a discrete location along the suspended concrete floor.

Figure 15A:
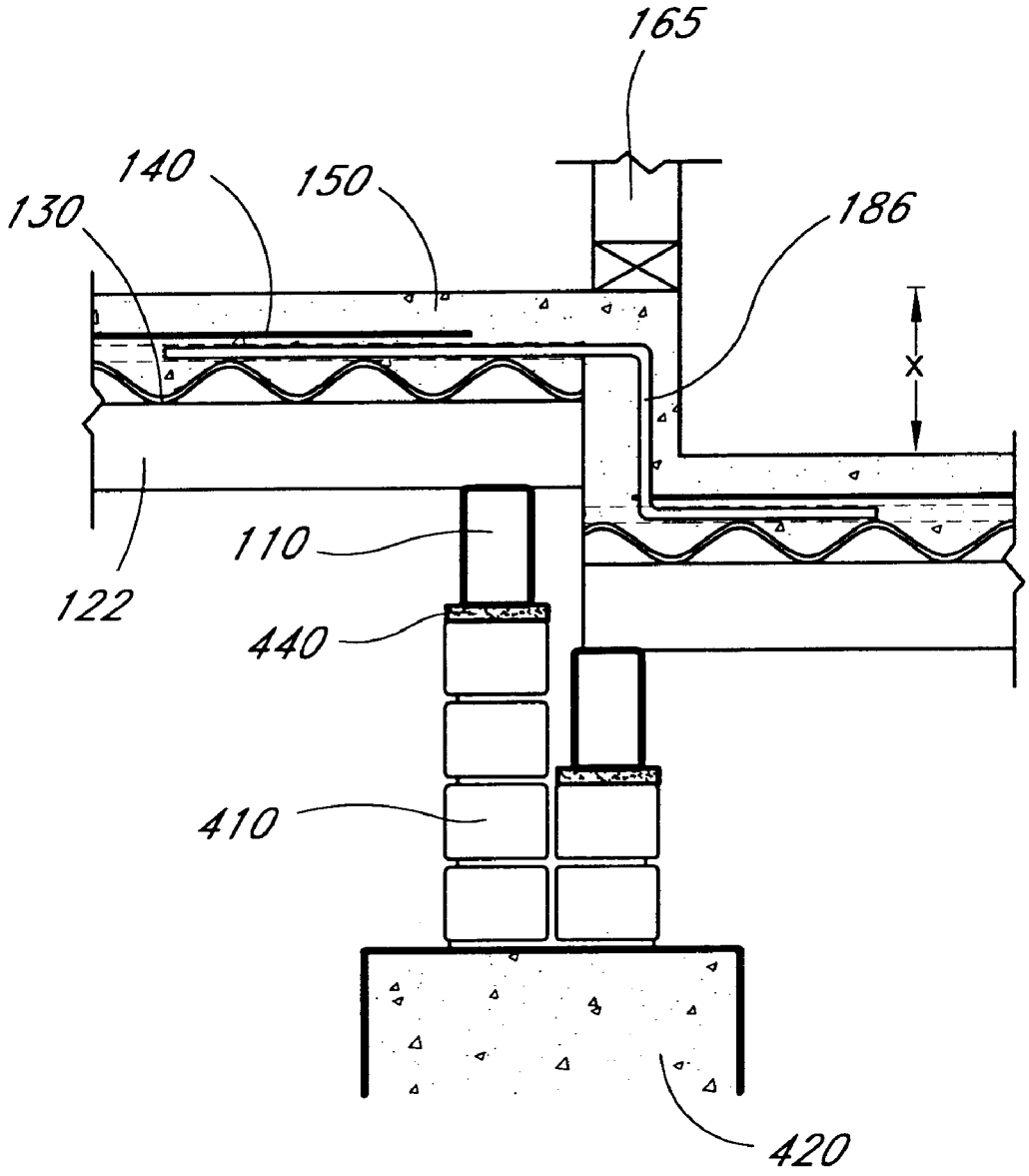
FIG. 15*a* is a cross-sectional view of an internal set down detail.
Figure 15B:
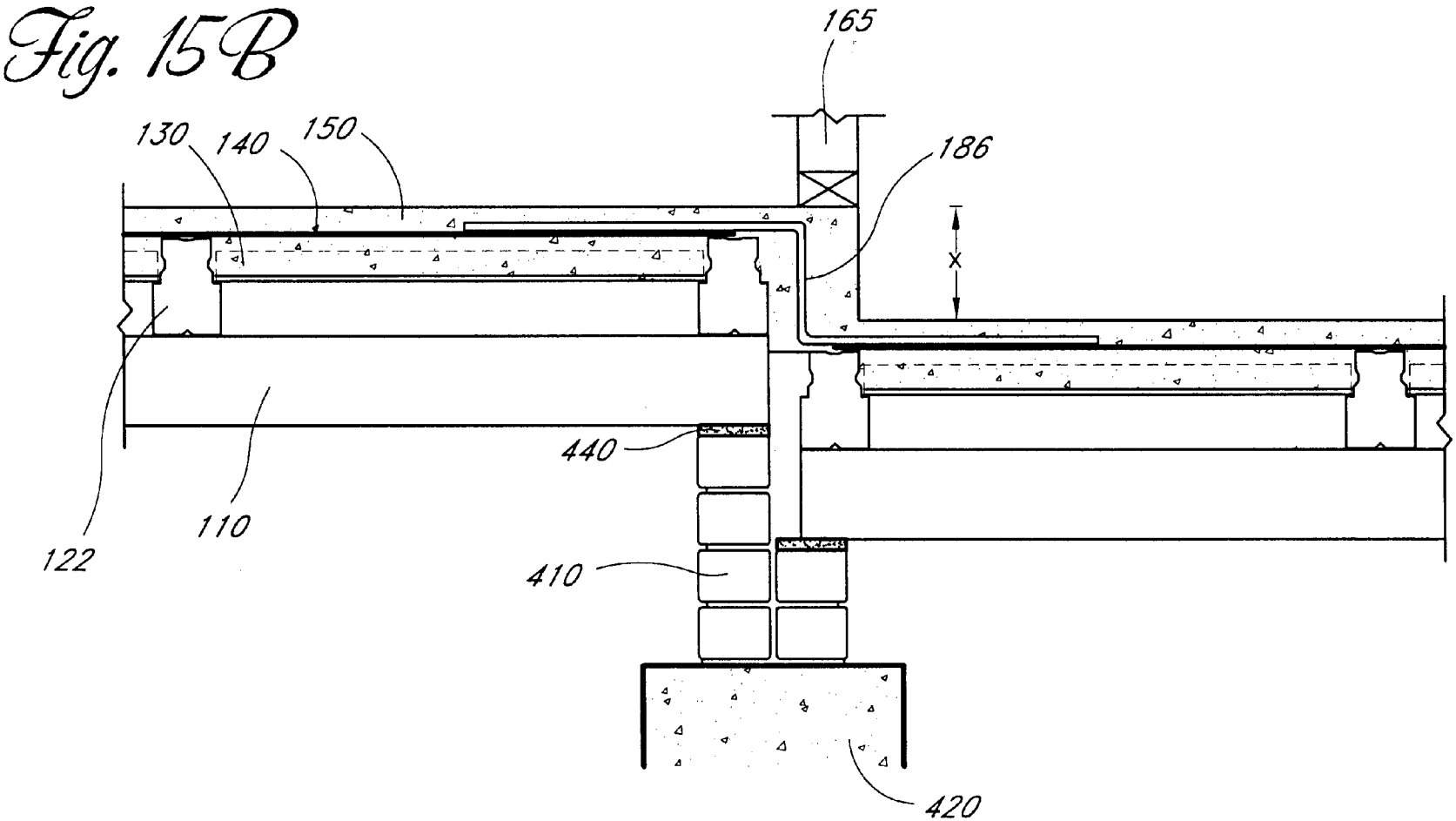
FIG. 15*b* is a cross-sectional view of an internal set down detail from a view orthogonal to that of FIG. 15*a*.

FIGS. 15*a* and 15*b* show an additional embodiment for creating an internal set down. A metal rod 186, such as a Y12 bar, is formed into substantially a Z-shape and is placed on top of the deck sheets 130 to provide additional strength for the concrete. The set down height "x" is determined by the builder according to the building plans. The use of the metal rod 186 provides additional strength to the poured concrete and allows the discrete-height flooring to be monolithic and poured at the same time. Traditional formwork is required to contain the set down portion of the floor until cured.

Figure 16:
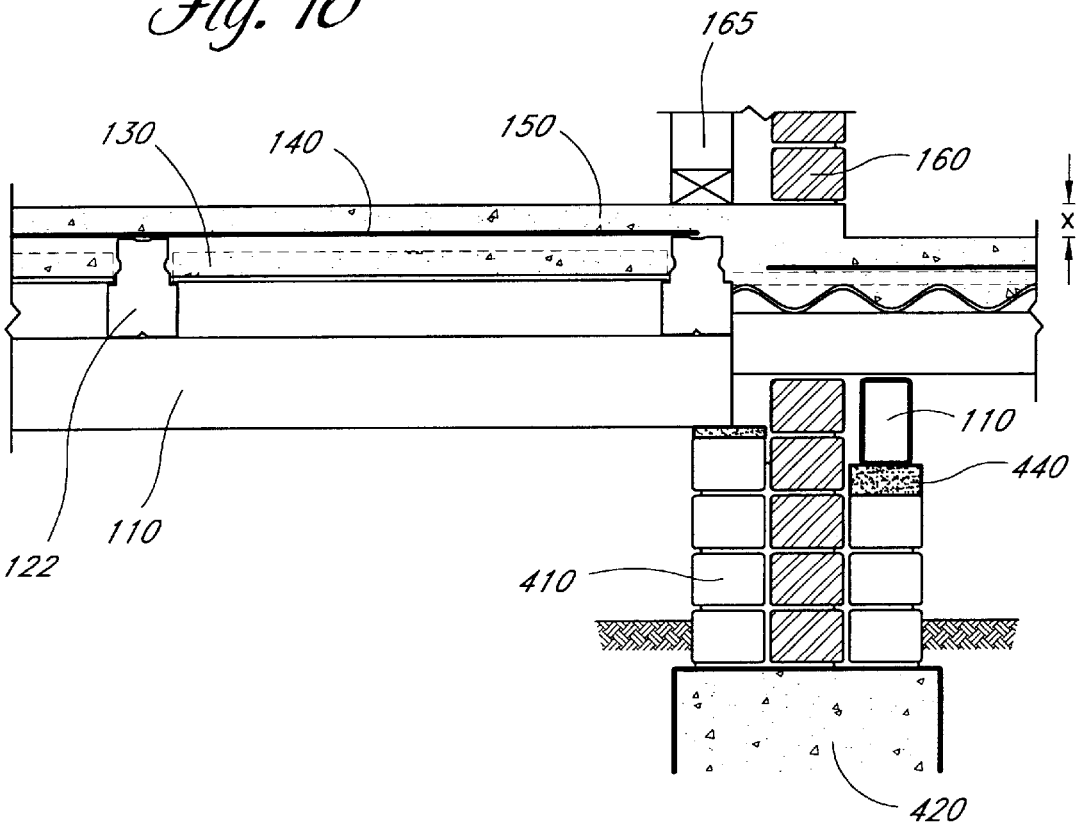
FIG. 16 is a cross-sectional view showing an external set down detail having a continuous slab.

FIG. 16 shows a continuous slab forming an interior and exterior floor. The exterior floor may be set down a distance "x" as per the building plan. The interior floor is supported as described above, while the exterior suspended floor may be supported by an exterior wall 160, in addition to the pier 410 and bearing member 110. The exterior slab provides support for an exterior wall 160 erected thereon. This embodiment has the added benefit of creating a monolithic floor and allowing the entire floor to be poured at once.

Advantages

The flooring system 100 described above has many advantages. A first advantage is that it is easily installed. System 100 is modular and can be put in place step by step without heavy equipment. In addition, the lightweight steel supporting members, (i.e., the bearing members 110 and joists 122) are quickly fixed together with self-drilling screws. A second advantage of system 100 is that installation and subsequent removal of extensive formwork is not required. The minimal amount of formwork is integral to the floor and is left permanently in place. A third advantage of system 100 is that it is cost competitive with traditional suspended concrete flooring systems. A fourth advantage of system 100 is that the suspended concrete flooring system components are easily mass-produced compared to pre-cast concrete and cast steel sections associated with other flooring systems. A fifth advantage of system 100 is that the suspended concrete flooring system exhibits greater strength than the sum of its parts—known as "composite action," which results in a floor that is exceptionally strong compared to the individual strengths of the structural members. A sixth advantage of the system 100 is that workers may walk on the suspended concrete flooring system 24 hours after the concrete topping is applied. Continued work may be performed on the suspended concrete flooring system after 7 days of curing. This allows for fast construction of the flooring system and the associated structures (e.g., the building for which the floor has been installed). The suspended nature of the system allows for under floor access for plumbing, electrical, or pest control services. Finally, there is no need to cut and fill sloping terrain prior to construction.

The many features and advantages of the disclosed embodiments are apparent from the detailed specification, and thus, it is intended by the appended claims to cover all such features and advantages of the described apparatus that follow the true spirit and scope of the disclosure.

Furthermore, since numerous modifications and changes will readily occur to those of skill in the art, the scope is not limited to the exact construction, operation and examples as described herein. Accordingly, other embodiments are within the scope of the immediately following claims.

What is claimed is:

1. A flooring system suspended above the ground, comprising:

a plurality of spaced-apart load-bearing members arranged substantially parallel to one another;

a plurality of spaced-apart joists having opposing generally vertical sides and arranged at substantially right-angles to said load-bearing members and supported by said load-bearing members, each joist having a substantially horizontal support surface formed along the length of at least one of said opposing generally vertical sides and spaced below an upper surface of the joist;

a plurality of deck sheets having first and second edges and supported between said joists at said edges by said support surfaces so as to span the space between said joists; and a concrete topping layer formed atop the deck sheets.

2. The system according to claim 1, wherein said load-bearing members are supporting walls.

3. The system according to claim 1, further including a shrinkage control mesh arranged atop said joists.

4. The system according to claim 1, further including one or more piers having a first end fixed to the ground and an opposing second end in contact with at least one of said load-bearing members.

5. The system according to claim 1, wherein each of said deck sheets is corrugated.

6. The system according to claim 5, wherein each of said deck sheets is made of fiber cement.

7. The system according to claim 1, wherein said support surface comprises a sidewall of a longitudinal groove formed along the length of at least one of said opposing generally vertical sides.

8. A method of installing a concrete flooring system suspended above ground upon a plurality of footings installed in the ground, the method comprising:

arranging on each of said footings a corresponding pier having a predetermined height;

positioning and securing a plurality of load-bearing members atop said piers;

positioning and securing a plurality of joists each having longitudinal rebates along sides thereof to said plurality of load-bearing members at substantially right-angles so that said joists are supported by said load-bearing members with a space between said joists;

placing a plurality of deck sheets in the longitudinal rebates thereby spanning the space between said joists which support each said sheets in a horizontal plane; and pouring concrete over said deck sheets so as to encompass said shrinkage control mesh and form a generally flat horizontal floor surface.

9. The method according to claim 8, further including, after placing a plurality of deck sheets, installing plumbing through said deck sheets.

10. The method according to claim 8, further including, after placing a plurality of deck sheets, arranging a shrinkage control mesh atop said joist.

11. A suspended flooring system, comprising:

a plurality of spaced apart load bearing members or supporting walls arranged substantially parallel to each other and supported above ground by supports fastened securely in the ground;

a plurality of spaced apart elongate joists mounted atop, and supported by, said load bearing members, each joist having a rebate formed along the length of one or more sides thereof;

a plurality of deck sheets configured to reside within said rebates thereby supported by said joists and forming a substantially horizontal deck spanning the distance between said joists;

a mesh placed above said deck sheets; and a concrete topping poured onto said deck sheets and encompassing said mesh, the concrete being worked to form a smooth, flat, horizontal upper floor surface.

12. The system of claim 11, wherein said joists have opposing sides, and further comprising rebates formed along both sides of said joists.

13. The system of claim 12, wherein said mesh is placed on top of said joists.

14. The system of claim 11, wherein said deck sheets are corrugated.

15. The system of claim 14, wherein said deck sheets are made of fiber cement.

16. The system of claim 11, wherein said mesh is a steel shrinkage control mesh.

17. A concrete flooring system, comprising:

a plurality of spaced apart parallel joists, each having a groove formed along a side thereof spaced below a top surface of said joist;

one or more deck sheets having first and second opposing edges configured to be slideably inserted into cooperating grooves of adjacent hoists, the first edge inserted into a groove in a first joist, and the second edge inserted into a groove in a second joist, thereby spanning the distance between the joist and forming a horizontal deck that is below the top surface of the joists; and a concrete layer atop the deck sheets.

18. The concrete flooring system of claim 17, further comprising a steel mesh placed atop said joists such that said mesh is spaced above said deck sheets.

19. The concrete flooring system of claim 17, wherein said deck sheets are formed of corrugated fiber cement.

* * * * *

UNITED STATES PATENT AND TRADEMARK OFFICE

CERTIFICATE OF CORRECTION

PATENT NO. : 6,755,001 B2
DATED : June 29, 2004
INVENTOR(S) : Peter Francis Eaton It is certified that error appears in the above-identified patent and that said Letters Patent is hereby corrected as shown below:

Column 9,
Line 36, delete “12ashows” and insert -- 12a shows --.

Column 12,
Line 45, delete “hoists” and insert -- joists --.
Line 48, delete “joist” and insert -- joists --.

Signed and Sealed this

Fourteenth Day of March, 2006

JON W. DUDAS
*Director of the United States Patent and Trademark Office*